US005259506A

United States Patent [19]

Pascale et al.

[11] Patent Number: 5,259,506

[45] Date of Patent: Nov. 9, 1993

[54] THERMALLY COMPARTMENTED LUNCH BOX APPARATUS INCLUDING GEL SACKS CONTAINING METALIC SPHERES

[76] Inventors: Virginia L. Pascale; Domenic J. Pascale, both of 123 E. 24th St., Chester, Pa. 19013

[21] Appl. No.: 916,486

[22] Filed: Jul. 20, 1992

[51] Int. Cl.[5] ..... A45C 11/20

[52] U.S. Cl. ..... 206/545; 62/457.1; 126/261; 206/549; 220/524

[58] Field of Search ..... 206/541, 545, 549, 546; 220/334, 420, 524; 62/457.1, 457.7, 457.9; 126/261, 204

[56] References Cited

U.S. PATENT DOCUMENTS

| | | | |
|---|---|---|---|
| 966,264 | 8/1910 | Sultzbauth | 220/420 X |
| 1,231,562 | 7/1917 | Bruegger | 220/420 |
| 1,549,269 | 8/1925 | Koree et al. | 220/420 X |
| 1,874,882 | 8/1932 | Brown | 206/545 |
| 1,979,222 | 10/1934 | Goodwin | 126/261 X |
| 2,034,472 | 3/1936 | Kesslinger | 62/457.1 X |
| 2,038,218 | 4/1936 | Holt | 62/457.9 X |
| 2,239,128 | 4/1941 | Sykes | 62/457.9 X |
| 3,640,420 | 2/1972 | Carter et al. | 220/334 X |
| 3,734,336 | 5/1973 | Rankow et al. | 206/545 X |
| 3,945,496 | 3/1976 | Gaetano | 206/546 |
| 4,830,190 | 5/1989 | Inagaki | 206/545 X |

*Primary Examiner*—Bryon P. Gehman
*Attorney, Agent, or Firm*—Leon Gilden

[57] ABSTRACT

A lunch box structure includes spaced compartments, each having a separate lid removably mounted overlying each compartment, with each lid including a chamber to receive respective heating and cooling packets therewithin to direct and isolate the compartments by way of an intermediate air chamber.

1 Claim, 4 Drawing Sheets

THERMALLY COMPARTMENTED LUNCH BOX APPARATUS INCLUDING GEL SACKS CONTAINING METALIC SPHERES

BACKGROUND OF THE INVENTION

1. Field of the Invention

The field of invention relates to lunch box apparatus, and more particularly pertains to a new and improved thermally compartmented lunch box apparatus wherein the same affords heated and cooled items respectively.

2. Description of the Prior Art

Lunch box apparatus of various types have been utilized in the prior art, wherein such apparatus directed to the thermal heating of components therewithin is indicated in U.S. Pat. No. 3,869,595 to Collins utilizing an electric heater and a water. bath for such heating.

U.S. Pat. No. 4,969,558 to Fisher sets forth a lunch box apparatus for use in microwaves for heating of components within the lunch box.

U.S. Pat. No. 4,830,190 to Inagaki sets forth a heating and cooling lunch box having an air intake opening and employing a heating and cooling source for each compartment in the form of fluid chambers positioned in adjacency to each compartment of the lunch box.

As such, it may be appreciated there continues to be a need for a new and improved thermally compartmented lunch box apparatus set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of lunch box apparatus now present in the prior art, the present invention provides a thermally compartmented lunch box apparatus wherein the same utilizes isolated compartments separated by a pneumatically sealed air chamber. As such, the general purpose of the present invention, which will be described subsequently in greater detail, is to provide a new and improved thermally compartmented lunch box apparatus which has all the advantages of the prior art lunch box apparatus and none of the disadvantages.

To attain this, the present invention provides a lunch box structure including spaced compartments, each having a separate lid removably mounted overlying each compartment, with each lid including a chamber to receive respective heating and cooling packets therewithin to direct and isolate the compartments by way of an intermediate air chamber.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved thermally compartmented lunch box apparatus which has all the advantages of the prior art lunch box apparatus and none of the disadvantages.

It is another object of the present invention to provide a new and improved thermally compartmented lunch box apparatus which may be easily and efficiently manufactured and marketed.

It is a further object of the present invention to provide a new and improved thermally compartmented lunch box apparatus which is of a durable and reliable construction.

An even further object of the present invention is to provide a new and improved thermally compartmented lunch box apparatus which is susceptible of a low cost of manufacture with regard to both materials and labor, and which accordingly is then susceptible of low prices of sale to the consuming public, thereby making such thermally compartmented lunch box apparatus economically available to the buying public.

Still yet another object of the present invention is to provide a new and improved thermally compartmented lunch box apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
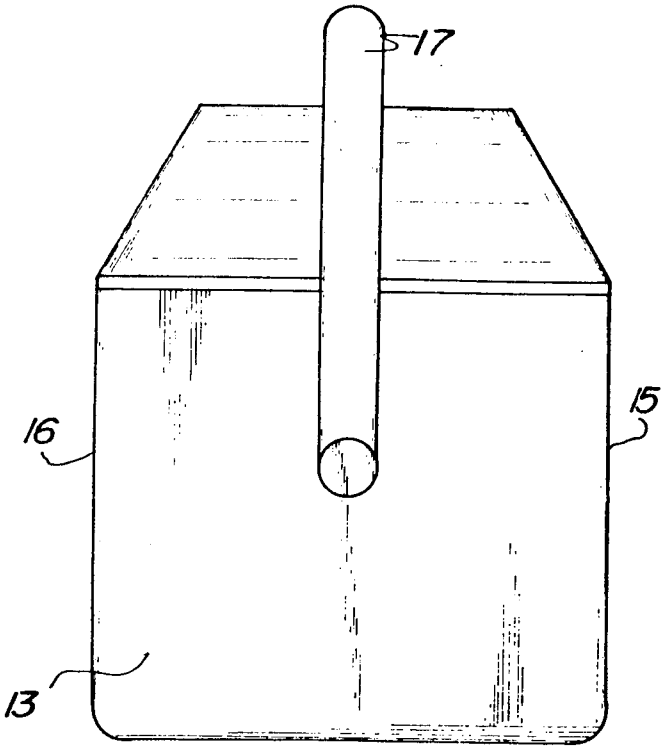
FIG. 2 is an orthographic side view of the instant invention.
Figure 1:
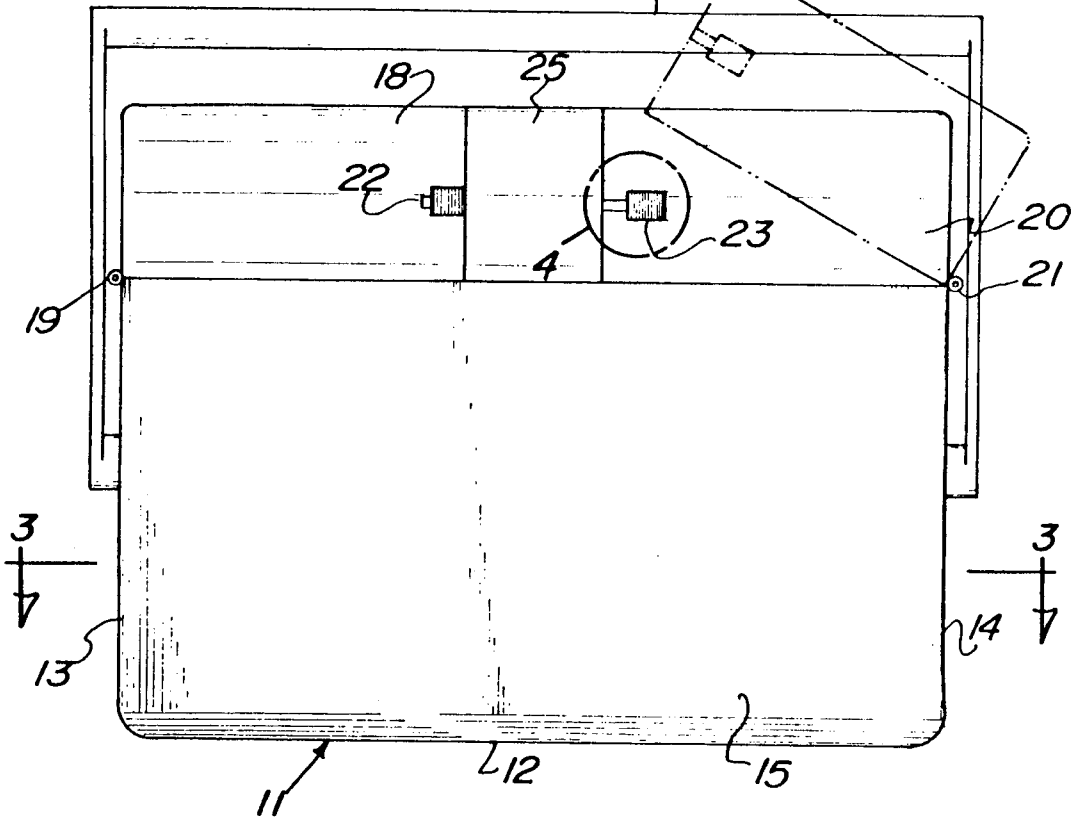
FIG. 1 is an orthographic frontal view of the instant invention.
Figure 4:
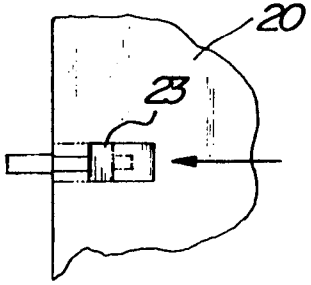
FIG. 4 is an orthographic view of section 4 as set forth in FIG. 1.
Figure 3:
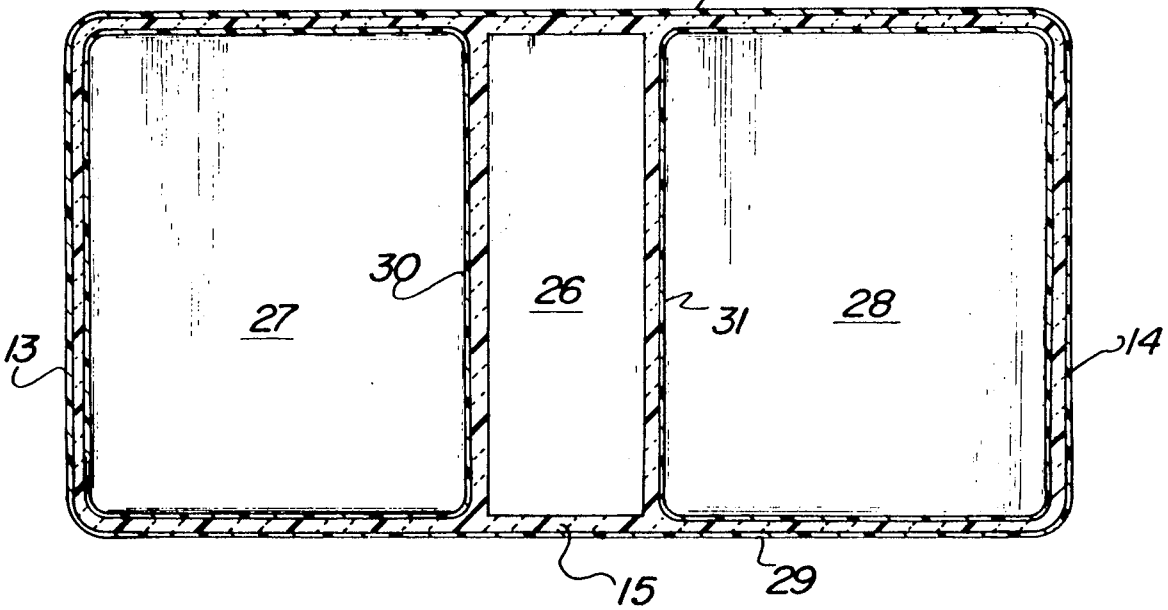
FIG. 3 is an orthographic view, taken along the lines 3—3 of FIG. 1 in the direction indicated by the arrows.

With reference now to the drawings, and in particular to FIGS. 1 to 7 thereof, a new and improved thermally compartmented lunch box apparatus embodying the principles and concepts of the present invention and generally designated by the reference numeral 10 will be described.

More specifically, the thermally compartmented lunch box apparatus 10 of the instant invention essentially comprises a container housing 11 having a floor 12, a first side wall 13 spaced from a second side wall 14, and a front wall 15 spaced from a rear wall 16. A handle loop 17 extends over the container housing 11 and of a U-shaped configuration having its side legs pivotally mounted at their outer terminal ends to the first and second side walls 13 and 14 as indicated. A first and second lid 18 and 20, each having a resilient hinge 19 and 21 mounted to upper distal ends of the respective first and second side walls 13 and 14 overlie respective first and second chambers 27 and 28 (see FIG. 3) of the container housing 11. The resiliency of the hinges permit the displacement of the lids when lifted relative to a central dome 25 defining a pneumatically sealed central air chamber 26 (see FIG. 3) to provide a thermal air barrier between respective first and second chambers. First and second latch bars 22 and 23 mounted to the respective first and second lids 18 and 20 are slidably received within respective opposed side walls of the central dome 25 to provide respective latching of the lids relative to the central dome. The housing and lids are formed with a polymeric exterior covering 29, with the first and second chambers 27 and 28 having respective first and second chamber liners 30 and 31. Polymeric foam is preferably utilized in the construction of the housings between the exterior covering and the chamber liners for its insulative properties.

Figure 5:
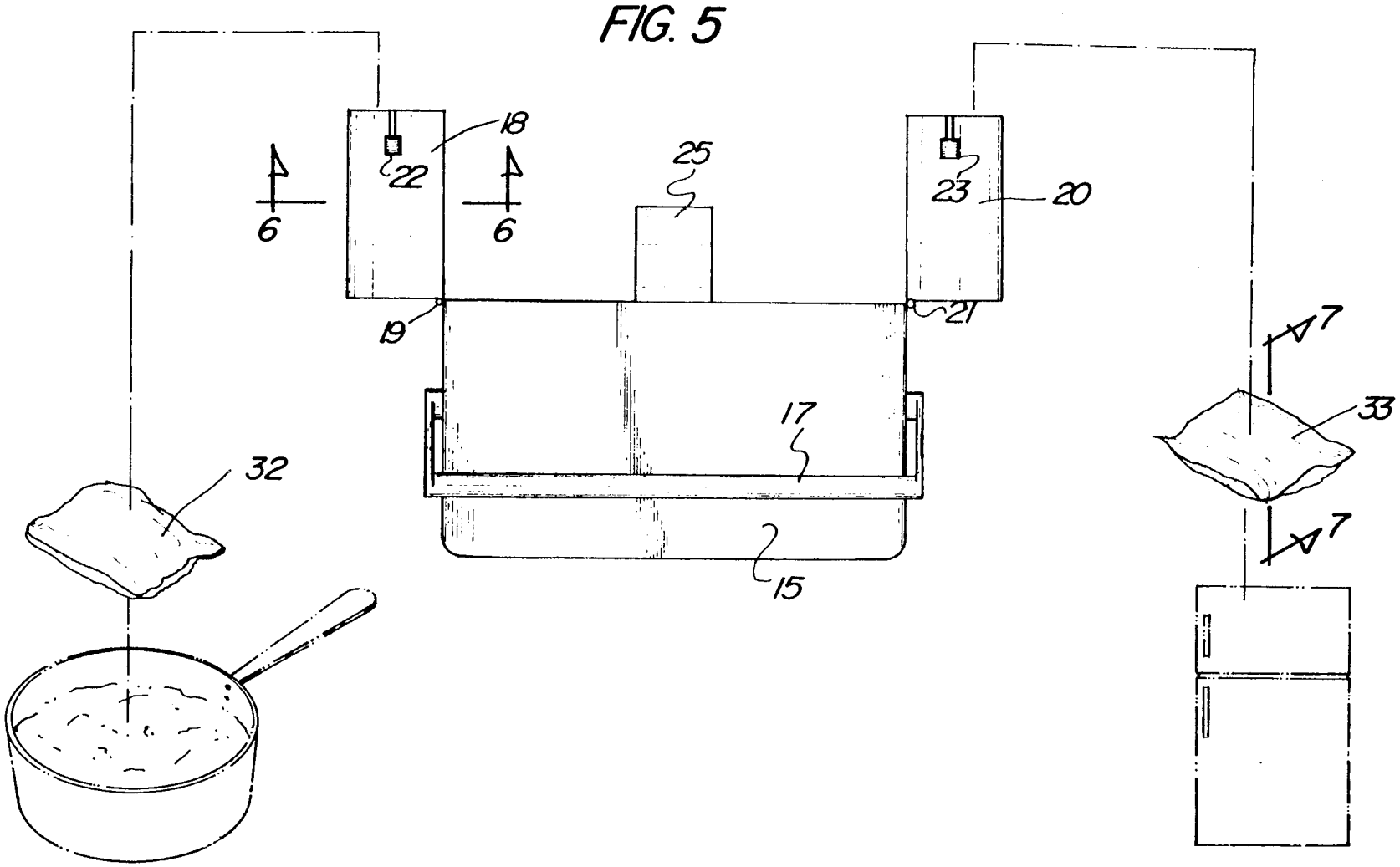
FIG. 5 is an orthographic view of the invention indicating the various heating and cooling packets arranged for positioning within the lids of the lunch box structure.
Figure 6:
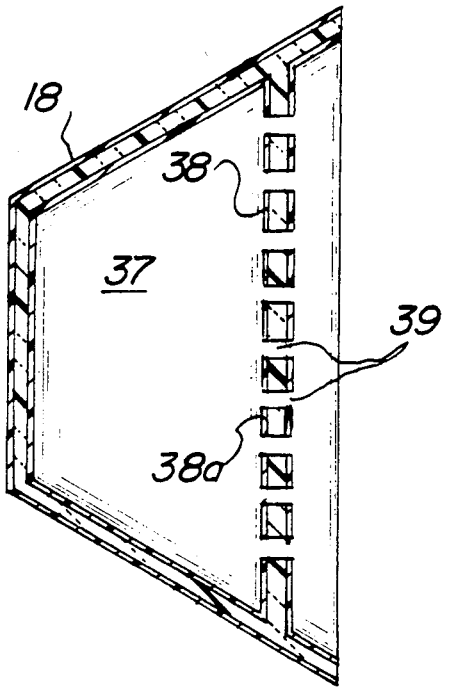
FIG. 6 is an orthographic view, taken along the lines 6—6 of FIG. 5 in the direction indicated by the arrows.
Figure 7:
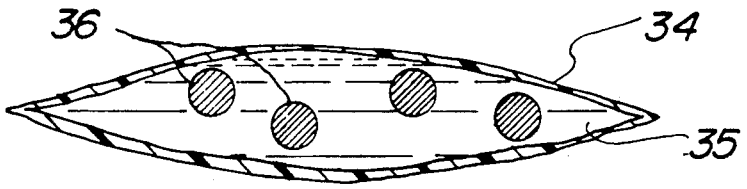
FIG. 7 is an orthographic view, taken along the lines 7—7 of FIG. 5 in the direction indicated by the arrows.

The FIG. 5 indicates the use of a heating and cooling sack 32 and 33, each of identical construction to be received within a respective chamber of each respective lid. Each lid is configured, as indicated in FIG. 6, of identical construction having a lid chamber 37 positioned and defined within the lid above a lid chamber floor 38 that includes a matrix of floor apertures 39 to provide for pneumatic communication with the associated lid and an underlying chamber 27 or 28. The heating and cooling sacks 32 and 33 are configured of a flexible covering 34 filled with a thermal gel 35 accommodating heating or cooling to retain such heat and chilling. To effect such heating and cooling, the packets may be positioned within a respective boiling fluid, as indicated, or within a refrigerant per the respective heating and cooling sacks 32 and 33. The thermal gel 35 further includes a plurality of metallic spheres 36 formed as permanent magnets for magnetic adherence and positioning of each sack relative to a ferrous metallic liner 38*a* of each chamber floor that is in confronting orientation relative to the lid chamber 37. In this manner, the associated sack is positioned over the associated apertures 39 to insure positioning and confrontation of the sack relative to the aperature, with the metallic spheres further utilized in retaining heating and cooling for sustained heating and cooling to the respective first and second chambers in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A thermally compartmented lunch box apparatus, comprising, a container housing, the container housing including a floor, a first side wall spaced from a second side wall, a front wall spaced from a rear wall;

a handle loop, the handle loop shaped of a U-shaped configuration, including a first leg and a second leg, with the first leg pivotally mounted to the first side wall, and the second leg pivotally mounted to the second side wall;

the container housing including a first chamber spaced from a second chamber within the container, with the first chamber positioned adjacent the first side wall coextensive between the front wall and the rear wall, and the second chamber positioned adjacent the second side wall between the front wall and the rear wall;

an intermediate pneumatically sealed air chamber is positioned between the first chamber and the second chamber and between the front wall and the rear wall;

a first lid pivotally mounted overlying the first chamber, and a second lid pivotally mounted overlying the second chamber, and a central dome positioned between the first lid and the second lid, with the first lid including a first latch bar slidably directed into the dome, and the second lid including a second latch bar slidably directed into the dome for selective securement of the first lid and the second lid relative to the dome;

a polymeric exterior covering coextensive with an interior surface of the container housing, the first chamber including a first chamber polymeric liner, the second chamber including a second chamber polymeric liner, wherein the first side wall, the second side wall, the front wall, the rear wall, the first lid, and the second lid are each formed of a polymeric foam;

the first lid includes a first lid chamber, the second lid includes a second lid chamber, wherein the first lid chamber and the second lid chamber are positioned within the first lid and the second lid respectively, and the first lid chamber includes a first lid chamber floor, the second lid chamber includes a second lid chamber floor, with the first lid chamber floor positioned over the first chamber, and the second lid chamber floor positioned over the second chamber, and wherein each chamber floor includes a matrix of apertures therethrough, the first chamber floor and the second chamber floor each include a ferrous metallic liner in confrontation with the first lid chamber and the second lid chamber respectively, and a flexible heating sack positioned within the first chamber, and a flexible cooling sack positioned within the second chamber;

the heating sack and the cooling sack each include a flexible covering, and the heating sack and the cooling sack each include a thermal gel contained within, and the heating sack and the cooling sack each further including a plurality of ferromagnetic metallic spheres contained within for adherence of the heating sack and the cooling sack to the first lid chamber floor and the second lid chamber floor, respectively.

* * * * *